United States Patent [19]

Gatto et al.

[11] Patent Number: 4,951,859

[45] Date of Patent: Aug. 28, 1990

[54] ANTI-FLUTTER TRACTOR DOOR

[75] Inventors: Jeffrey V. Gatto, Endwell; Joseph T. Wilson, III, Endicott, both of N.Y.

[73] Assignee: International Business Machines Corp., Armonk, N.Y.

[21] Appl. No.: 322,432

[22] Filed: Mar. 10, 1989

[51] Int. Cl.[5] ..... B65H 20/20; B41J 11/26

[52] U.S. Cl. ..... 226/74; 226/75; 400/616.1; 400/616.2

[58] Field of Search ..... 226/74, 75, 76, 82, 226/87; 400/616.1, 616.2

[56] References Cited

U.S. PATENT DOCUMENTS 4,706,861 11/1987 Kerivan ..... 226/74
4,817,842 4/1989 Wilson, III ..... 226/74

FOREIGN PATENT DOCUMENTS 62-82059 4/1987 Japan ..... 226/74

*Primary Examiner*—Stuart S. Levy
*Assistant Examiner*—Paul Bowen
*Attorney, Agent, or Firm*—John S. Gasper

[57] ABSTRACT

A tractor feed mechanism for feeding print forms comprises a continuous flexible pin belt wrapped around a pair of drive pulleys rotatably supported by a tractor body. Pins projecting from the flexible belt engage the forms via perforation in the forms. A door pivotally connected to the tractor body and is rotatable between an open condition in which paper can be placed on or removed from the pins and a closed position in which the forms can be restrained from becoming disengaged from the pins during feeding by the pin belt. A cam rotatable with the door and a spring is operable therewith produce a first restraining force on the door in its closed position which allows the door to be lifted a predetermined amount by the forms during feeding by the pin belt to accommodate variations in the thickness of the forms caused by buckling or folds. The cam and spring produce a second restraining force while the door is in the closed position of a magnitude which prevents lifting of the door beyond the predetermined amount. The cam is structured such that the first restraining force produced by the spring means remains substantially constant up to the point where the door is lifted said predetermined amount.

14 Claims, 4 Drawing Sheets

ANTI-FLUTTER TRACTOR DOOR

FIELD OF THE INVENTION

This invention relates to feed mechanisms and particularly feed mechanisms commonly called tractors which feed documents in printers.

BACKGROUND OF THE INVENTION

Tractor feed mechanisms commonly used in a printer apparatus comprise a continuous flexible pin belt wrapped around a pair of drive sprockets or pulleys rotatably supported by a frame assembly or body mountable on drive and guide bars of the paper feed assembly of the printer. In addition to supporting the pin belt and drive sprockets, the tractor body has surfaces for guiding paper so that perforations near the edges of the paper are in proper alignment to receive and be engaged by drive pins carried by the belt as it is rotated by the sprockets to feed the paper past a print station of the printer. The paper may be a continuous web and may have multiple layers in which case it is commonly called a multipart form and the tractor feed mechanism is referred to as a forms feed tractor.

It is common practice to provide such feed mechanisms with a door or lid for constraining the paper so that it remains in contact with the guide surface of the tractor body and does not become disengaged from the pins. The door is provided with a hinge connection to the body. This enables the door to be rotated around the hinge axis between a closed position where the paper is constrained to remain on the pins and an open position to allow paper to be placed on or removed from the tractor. A spring is used to hold the door in either the closed or open position. In a copending application Ser. No. 150,348 filed on 01/29/89, now U.S. Pat. No. 4,817,842, issued on Apr. 4, 1989; the force for holding the door in the closed position is provided by a flat leaf spring which is bent so as to be spring loaded against the curved surface of door position cam control means rotatable with the door. Other tractors well known in the art use coil springs connected to the door and tractor body to provide the door constraining force.

When perforated webs are fed at high speeds and accelerations, there is a tendency for the forms to slide up the side of the feed pins toward the door. This motion is caused by the vibrations induced in the paper web due to high acceleration forces. The sliding effect is aggravated by changes in thickness of the paper due to folds. The condition is worsened where multilayer forms are used. The sliding motion on the pins causes abrasion of the feed pins and causes the registration of the forms to vary with respect to the position of forms feed tractors. When the lift force is strong enough, it causes the door itself to move up and down in a fluttering motion. Conceivably, the force might reach a point where the door itself might fly open and the forms would disengage from the feed pins.

Various attempts have made to maintain perforated paper on the pins. One such attempt uses a pressure belt which is pressed onto the pins of the belt above the paper. Such arrangements may be seen in U.S. Pat. Nos. 3,209,972; 3,608,801; and 3,669,329. A like tractor is used in the IBM 4248 Printer. Such tractors while effective tend to be complex and costly devices.

Another attempt to solve the paper lifting problem is to provide a structure in which the paper gap between the door and the top of the surface of the pin belt is as close as possible to the top of the paper. In fact, the gap is made so small that the door may actually contact the surface of the paper. U.S. Pat. No. 4,611,737 shows such a tractor mechanism. This requires a door stop mechanism and in order to maintain such fine dimensional spacing very precise manufacture is involved which can be difficult to achieve and is costly. A further problem with such a structure is that relatively high forces are required to prevent the forms from disengaging from the pins when folds in multilayer forms pass through the door gap. A consequence of this is that unnecessarily high door to paper forces are required by that design which generates high system friction, increases the wear rate of the tractor door and body, and causes deformation of the perforations in the forms. Another problem produced with the design of the mentioned patent is that the pressure on the paper in the region where the paper is disengaging from the tractor feed pins impedes the stripping of the paper from the pins and paper jams result.

SUMMARY OF THE INVENTION

It is an object of the invention to provide a tractor feed mechanism in which the spring holds the door against the forms with a light force and produces a high force if the forms try to force the tractor door open.

It is an object of the invention to provide a tractor feed mechanism in which the door when closed rests directly on the paper.

It is an object of the invention to provide a tractor feed mechanism in which the door applies pressure to the paper only in the region between the areas where the paper engages and disengages from the feed pins and there is a clearance between the door and paper in the region where the pins of a feed belt are withdrawn from the feed holes in the paper.

Specifically the above objects are achieved by providing a tractor door with door control cams and spring means acting thereon. The door is allowed to rest on the paper at all times when closed except in the sprocket regions where paper disengages or engages with the pins on the belt. The spring is a flat leaf spring which bears on curved or straight sections of the cams depending on whether the door is in the closed or the position. In accordance with this invention, the cam surface is designed to have two curved surfaces which coact alternately with the spring to maintain the door in the closed position. One curved surface is positioned on the cam such that a light force is applied to the paper while the other curved surface is positioned relative to the first so that a strong restraining force is applied to the paper. In this way, the forces on the paper can be maintained relatively low during feeding to minimize wear on the door, the tractor body and the pins of the belt. At the same time, the door is prevented from lifting too far by the paper to allow the paper to slide up the pins and causing misregistration of the perforations in the paper with the tractor or causing the door to fly open. In accordance with another feature of this invention, the door, when closed, rests on the surface of the paper in the vicinity of the feed pins of the belt. In fact the door would rest on the body of the tractor near the feed belt or the feed belt when no paper is in the tractor. The door is designed at its ends in such a manner that a clearance is provided in the region where the pins are withdrawn from the feed holes. In this manner the problem of paper jamming is avoided.

The invention is an improvement over pending application No. 150,348 which is incorporated herein by reference.

The foregoing as well as other features, objects and advantage will be readily apparent from the following more detailed description of the invention.

DETAIL DESCRIPTION OF THE INVENTION

Figure 1:
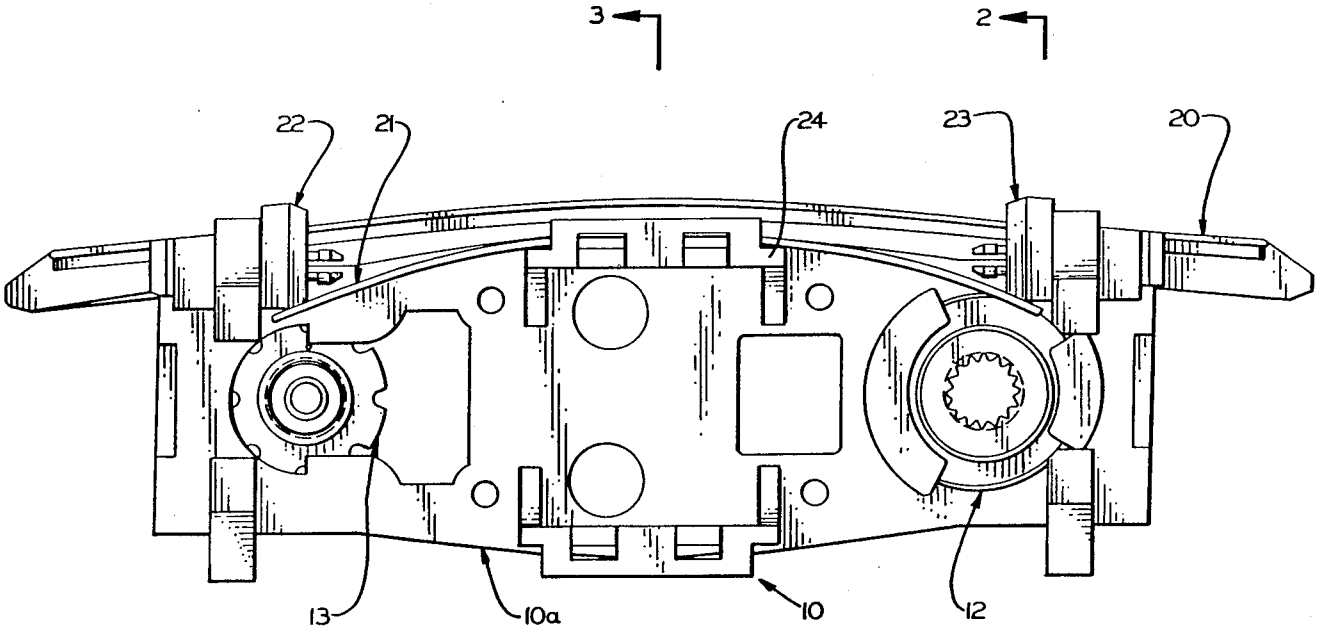
FIG. 1 is side view of a paper feed tractor of the type in which the invention is used.

As seen in the figures, a forms feed tractor 10 comprises an endless drive belt 11 that passes around a drive pulley 12 at one end and an idler pulley 13 at the other and transmits motion to the paper 14. As previously discussed this motion can be intermittent and occurs at high repetition rates. The drive pulley 12 may be journaled to the sidewalls which comprise the frame or body 10*a* of the tractor 10 and idler pulley 13 may be supported by a movable support frame (not shown) between the sidewalls of body 10*a* and which allows tension to be applied to belt 11 as more fully described in copending application, Serial No. 07/303,707 filed Jan. 27, 1989. Belt 11 may be of various types of endless flexible belt but preferably comprises a thin flexible steel band 15 with pins 16 and gear teeth 17 attached thereto by molding through elongate apertures in band 15 as shown in copending application Ser. No. 153,394 filed on 02/08/88. As shown in the drawing, gear teeth 17 on the inside of band 15 engage slots 18 in pulleys 12 and 13 while pins 16 on the other side, i.e. the outer side, of band 15 engage feed holes in paper 14. Tractor door 20 is rotationally positioned with respect to tractor body 10*a* by the action of flat door spring 21 operating on door cams 22 and 23. Spring 21 is supported on rigid platform 24 projecting from the side of tractor body 10*a* with the opposite ends of spring 21 bearing on beveled edges of cams 22 and 23. In the preferred form of tractor door in which this invention is practiced, the cams 22 and 23 are integral with the hinge elements of the door 20 as more fully described in copending application Ser. No. 150,348.

Figure 2:
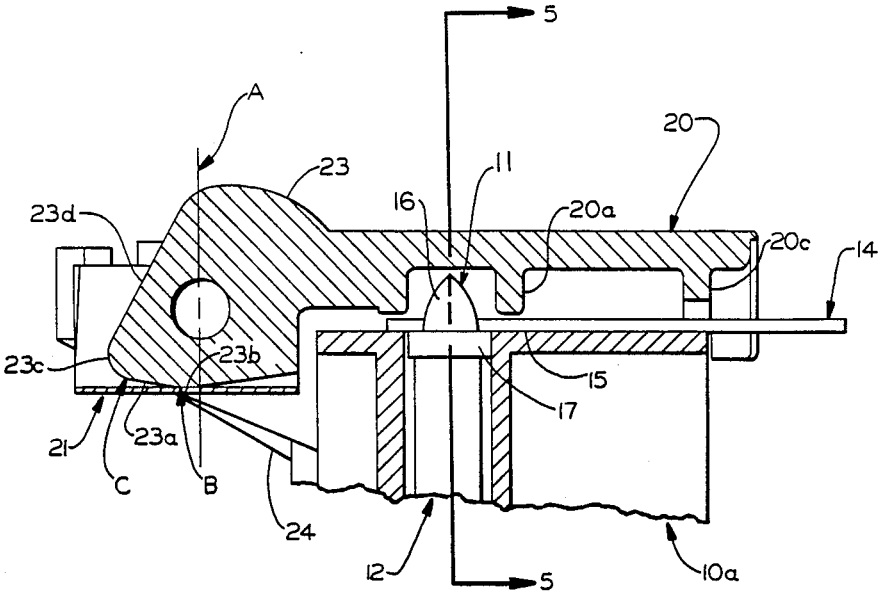
FIG. 2 is a transverse section taken through the door and one of the cams of FIG. 1 along line 2—2 showing details of one of the door cams and spring arrangement.

The relationship between door cams 22 and 23 and spring 21 is shown in FIG. 2. In accordance with the invention, cam 23 has curved surfaces or lobes 23*b* and 23*c* separated by flat or concave surface 23*a*. Cam 23 can also have flat surface 23*d* which engages spring 20 when door 21 has been rotated to an open position. Flat spring 21 bears against cam 23 and is always perpendicular to the side of tractor body 10*a*. The torque applied to door 20 is the product of the distance between the pivot centerline A which is perpendicular to the surface of spring 21, and the point of contact between cam 23 and spring 21; the deflection distance of the spring; and the spring rate. Spring 21 has the same relationship with cam 22 and produces a complementary action on door 20.

Figure 3:
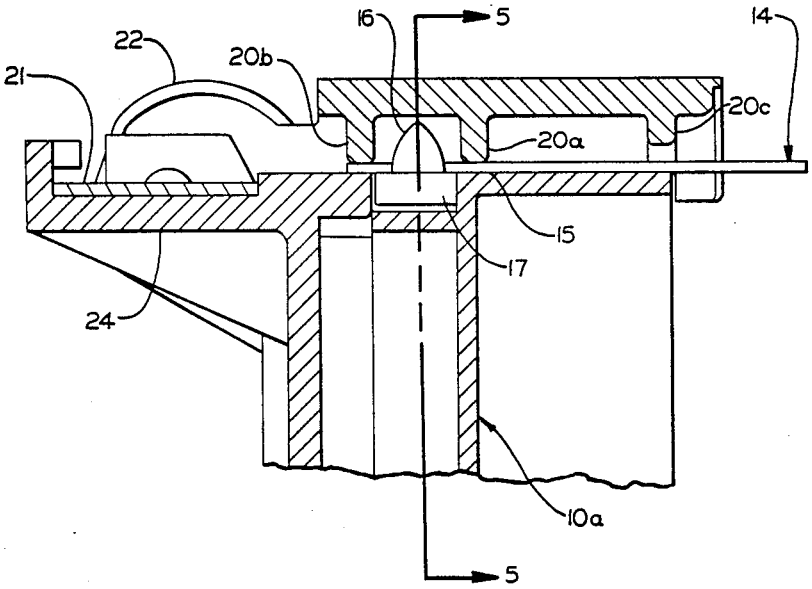
FIG. 3 is a transverse section of FIG. 1 taken along line 3—3 showing additional details of the invention.
Figure 4:
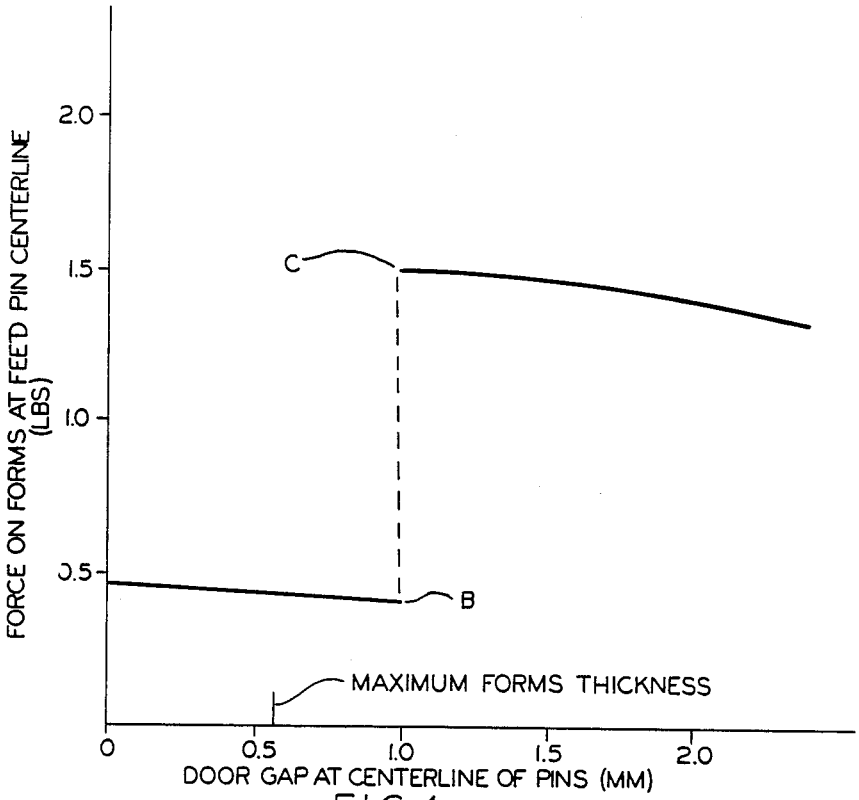
FIG. 4 is a graph showing the relations of force to deflection of the door in the tractor shown in the preceding figures.

If the contact point is to the left of the centerline A, the torque produced by the deflected spring 21 tends to close the door. If the contact point is to the right of the pivot centerline A, the torque tends to open the door 20. In accordance with the invention, when door 20 is in the closed position shown in FIGS. 2 and 3, spring 21 as seen in FIG. 2 contacts lobe 23*b* at point B. Because point B is relatively close to centerline A, a relatively low door closing torque is produced by spring 21. Lobe 23*b* is designed so that the point of contact anywhere on its surface is to the left of centerline A and produces a light force with very little variation in the magnitude of the door closing torque. This is attributable to the fact that the magnitudes of deflection and torque change in opposite directions; i.e. the deflection increases almost as much as the torque distance decreases. For example, if the door 20 is rotated clockwise from the position shown, such as when the bottom surface of door rib 20*a* as shown in FIG. 3 rests on a single part form 14 as distinct from resting on a multipart form, or when door 20 is dropped slightly during feeding as a result of changes in the thickness of the paper 14, the lever length would decrease only slightly as would the door closing torque. However, due to the contour of lobe 23*b*, the deflection of spring 21 may increase slightly but not necessarily the same amount as the decrease in torque. If the door 20 was rotated slightly in the counter clockwise direction such as would occur with an unflattened fold in the form pressing on the bottom of rib 20*a*, the contact point would shift to C. Because C is farther from the pivot centerline A compared to contact point B, a much larger door closing torque is generated that would resist further opening of door 20. Cam 23 can be designed so that the contour of lobe 23*b* is such that the high torque is generated when door opening was slightly larger than the maximum forms thickness as shown on the graph of FIG. 4. In this manner, the door closing force is maintained low regardless of the thickness of form 14 and becomes high only when some undesirable condition such as an unflattened fold which is greater than the thickest forms applies a counter rotating torque to door 20. Thus paper 14 is prevented from sliding up pins 16 to the point where misregistration problems can occur. At the same time, the level of drag is maintained low during feeding. So long as the paper 14 remains on the pin, low drag is imposed on the surface of paper 14. However, when the lift force on paper 14 exceeds the desired limit, the point of contact between spring 21 and cam 23 shifts from point B on lobe 23*b* to point C on lobe 23*c* and the force level on door 20 quickly changes to a high level. This is illustrated in FIG. 4 where the door closing torque exerted by contact of spring 21 and lobe 23*b* is low and varies only slightly over the distance of rotation caused by forms of differing thickness but changes in a step like manner when the rotation of door 20 cause the point of contact to shift to C on lobe 23*c*. A stable detent position of door 20 does not exist when flat surface 23*a* contacts spring 21 because both lobes 23*d* and 23*c* lie to the left of centerline A.

Figure 6:
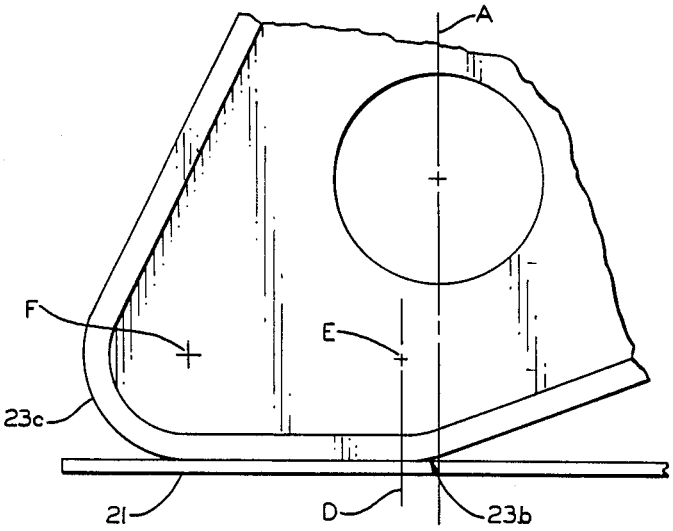
FIG. 6 an enlarged drawing showing further details of a cam used in the tractor of the preceding figures.

The structural details of lobe 23 can be seen more clearly in FIG. 6. As shown, lobe 23*b* is a curved surface whose center of curvature E has a shorter radius from the pivot point of door 20 than the center of curvature F of lobe 23c. In addition, the center of curvature E is on a line D which is to the left of pivot center line A. This assures that any point on lobe 23b will always produce a door closing torque and because of the shorter pivot radius, the door closing torque will be relatively small compared to the door closing torque produced by lobe 23c.

FIG. 3 shows the relationship of the door 20 midway between the pulleys 12 and 13. In this region, ribs 20a and 20b adjacent the pins 16 press on the paper. Tractor body 10a has no door stop preventing such contact with the paper in response to door closing torque applied by spring 20 when in contact with lobe 23b as well as with lobe 23c. Rib 20c is purposely shortened to clear the top of paper 14 to thereby minimize drag.

Figure 5:
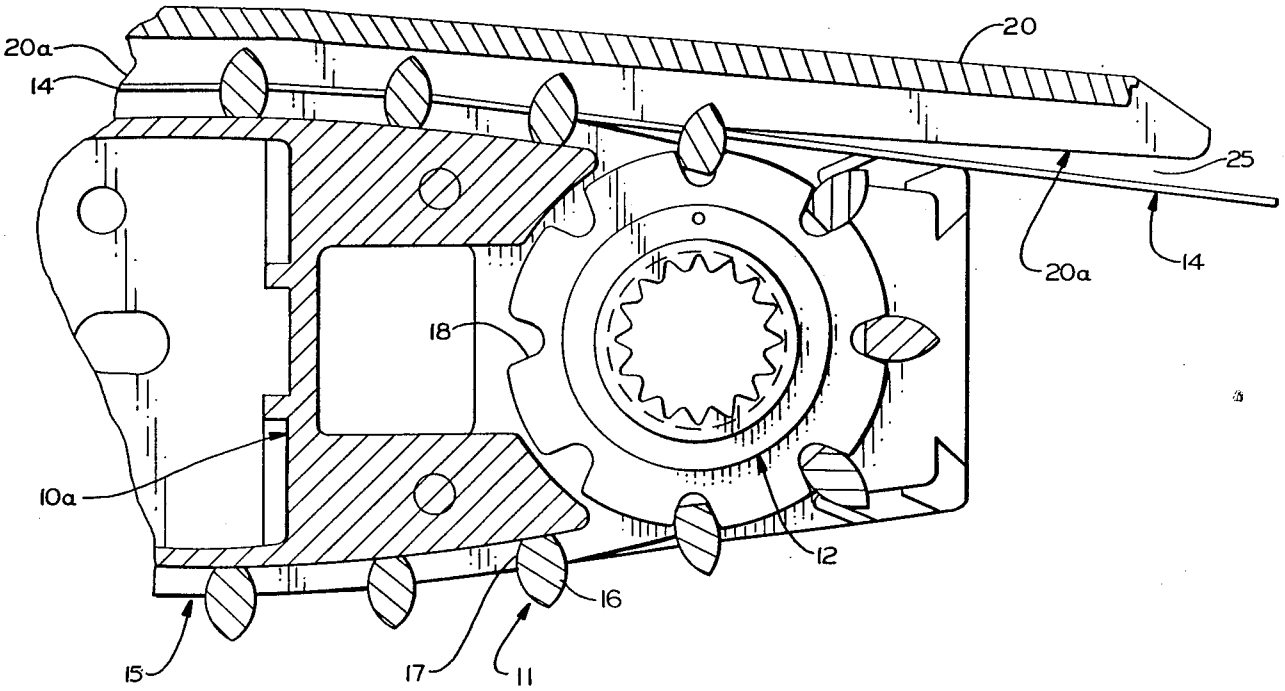
FIG. 5 is a section of a fragment of the tractor taken along lines 5—5 in FIGS. 2 or 3 showing the relationship of the door and the paper at the point where the paper is taken off the pins of the feed belt.

As seen in FIG. 5, there is an increasing separation 25 between the door 20 and paper 14 in the region where pins 16 are withdrawn from feed holes in paper 14. This was found to be necessary when the ribs 20a and 20b were allowed to rest on the top surface of the paper in the region between pulleys 12 and 13. Provision of this clearance in the region where the pins are withdrawn from the feed holes prevents the ribs from interfering with the stripping of forms 14 from pins 16 and solves the problem of the paper jams. The uniformly increasing clearance is also provided at the end of the tractor opposite the drive pulley end so that the forms could pass through the tractor in either direction.

Thus it will be seen that an improved tractor feed mechanism has been provided which prevents paper forms of different thicknesses from sliding up the feed pins of a tractor feed belt. The invention also provides a solution to the problem of paper jamming when tractor door is allowed to bear on the top of the forms during feeding.

While the invention has been particularly shown and described with reference to a preferred embodiment(s) thereof, it will be understood by those skilled in the art that various changes in form and details may be made therein without departing from the spirit and scope of the invention.

What is claimed is:

1. A feed mechanism for a printer for feeding a perforated web, a tractor body having a guide surface for said web, web drive means supported by said tractor body and having pin means which engage the web in its perforations for moving said web along said guide surface, a door pivotally mounted on said tractor body so as to be rotatable between open and closed positions relative to said guide surface, said door having a surface engageable with the surface of said web when said door is in closed position, cam means rotatable with said door, said cam means having first and second cam surfaces angularly separated and defining said open and closed door positions respectively, said cam means further including a third cam surface between said first and second cam surfaces defining a second closed door position, and spring means cooperable with said cam means for controlling the angular position of said door, said spring means cooperating with said second and third cam surfaces of said cam means for applying first or second closing forces to said door when in said first or second closed positions for resisting lifting forces applied to said door by said web during the feeding thereof by said drive means.

2. A feed mechanism in accordance with claim 1 wherein said first and second door closing forces applied by said spring means cooperating with said second and third cam surfaces of said cam means are of unequal magnitude.

3. A feed mechanism in accordance with claim 2 wherein said first closing force is a relatively light force on the surface of said web which enables said door to be lifted a limited amount by said web and said second closing force is a strong force which prevents lifting of said door by said web beyond said limited amount.

4. A feed mechanism according to claim 3 wherein said web has one or more web layers, said door is liftable different amounts when in said first closed position dependent on the number of said web layers, and said magnitude of said first door closing force applied by said spring means with said second cam surface remains substantially constant for a predetermined number of said web layers.

5. A feed mechanism according to claim 3 wherein said web has one or more web layers, and said magnitude of said second closing force applied by said spring means and said second cam surface at said second closed position occurs when said door is lifted by said web an amount slightly greater than needed to accommodate a predetermined number of said web layers.

6. A feed mechanism according to claim 1 wherein said web drive means comprises an endless belt with said pin means carried thereby, said belt having a portion extending between a pair of spaced drive elements with said pin means being withdrawn from said feed holes in the regions of said drive elements, and said surface of said door is engageable with said web in the region between said regions where said pin means are withdrawn from said feed holes of said web.

7. A feed mechanism according to claim 6 wherein said door includes rib members having said surface which engages said web in said regions.

8. A feed mechanism according to claim 7 wherein said door has portions extending beyond said regions where said pin means are withdrawn from said feed holes, and said door portions are separated by a gap from and do not make contact with said web in said extended regions.

9. A feed mechanism according to claim 8 wherein said gap between said door and said web in said regions beyond said pin withdrawal region is an increasingly expanding gap.

10. A feed mechanism for feeding paper having perforations in a printer comprising in combination a tractor body, drive means supported by said tractor body including pin means for engaging said perforations and thereby feeding paper along said tractor body, a door pivotally connected to said tractor body, said door being rotatable from an open to a closed position where said door is engageable with said paper for retaining said paper in engagement with said pin means, said door being subjected in said closed position to variable lifting forces producable by said paper during movement by said drive means, said lifting forces tending to cause said door to be rotatable from said closed position toward said open position and to cause disengagement of said paper from said pin means, and means for controlling the range of lifting of said door by said paper including means for biasing said door toward said closed position and against said paper comprising cam means rotatable with said door and spring means loadable by said cam means, said cam means and said spring means being adapted for producing first and second level biasing forces on said door in opposition to said lifting forces, said first level biasing force having a magnitude less than and said second level biasing force having a magnitude greater than a predetermined lifting force producable by said paper whereby said door is liftable by said paper a predetermined amount which accommodates predetermined variations in the thickness of said paper without said paper becoming disengaged from said feed pins by said lifting force.

11. A feed mechanism in accordance with claim 10 wherein said magnitude of said first level biasing force produced by said biasing means is substantially constant over said predetermined amount said door is liftable by said paper.

12. A feed mechanism in accordance with claim 10 wherein said cam means is a rotary cam means having a planar and first and second convex surfaces at different angular positions on said cam means, said planar cam surface defining an open position and said first and second convex surfaces defining first and second closed positions for said door, and said spring means comprises an elongate elastic beam member deflectable by said cam means, said elastic beam having a longitudinal axis lying in a plane with the axis of said rotary cam means, said first and second convex surfaces engageable with said said beam member on the same side of said longitudinal axis.

13. A feed mechanism in accordance with claim 12 wherein said first and second level biasing forces are produced as a result of said first and second convex surfaces having different radial distances from said axis of said rotary cam means.

14. A feed mechanism in accordance with claim 13 wherein said first convex surface has a shorter radius and engages said beam member closer to said longitudinal axis than said second second convex surface.

* * * * *